US006060015A

United States Patent [19]

Kågström et al.

[11] Patent Number: 6,060,015

[45] Date of Patent: May 9, 2000

[54] METALLURGICAL FURNACE UNIT

[75] Inventors: Per Kågström; Lars Lundin; Sam Marklund, all of Skellefteå , Sweden

[73] Assignee: Boliden Contech A. B., Sweden

[21] Appl. No.: 09/072,451

[22] Filed: May 5, 1998

[30] Foreign Application Priority Data

May 23, 1997 [SE] Sweden ..... 9701921

[51] Int. Cl.[7] ..... C21C 5/50

[52] U.S. Cl. ..... 266/246; 266/275

[58] Field of Search ..... 266/245, 246, 266/275

[56] References Cited

U.S. PATENT DOCUMENTS

| | | | |
|---|---|---|---|
| 3,497,197 | 2/1970 | Puhringer . | |
| 4,447,966 | 5/1984 | Mollenkopf et al. . | |
| 5,143,683 | 9/1992 | Glassman et al. | 266/246 |

FOREIGN PATENT DOCUMENTS

| | | |
|---|---|---|
| 68786 | 3/1949 | Denmark . |
| 924077 | 1/1944 | Germany . |
| 1218441 | 1/1971 | Germany . |
| 1218442 | 1/1971 | Germany . |
| 2340618 | 2/1975 | Germany . |

*Primary Examiner*—Scott Kastler
*Attorney, Agent, or Firm*—Burns, Doane, Swecker & Mathis L.L.P.

[57] ABSTRACT

A metallurgical furnace unit (1) includes a cylindrical furnace body (2) which is intended for rotation and/or tilting or like movement and is provided with at least one ring (7) mounted outside the furnace body (2) and functioning to enable such movement to take place. Each ring (7) is spaced from the furnace body (2) and connected to said body by means of a force transferring supporting-member (6) that extends in the longitudinal direction of the furnace unit (1). The supporting member (6) is adapted to prevent the transfer of furnace body movements caused by thermal expansion to the ring (7), and to take-up external loads from the intrinsic weight of the furnace body and the weight of the furnace charge. The invention is characterized in that the supporting member (6) has the form of a closed mantle which surrounds the furnace body (2) and which is connected to the furnace body (2) and to the ring (7) respectively by means of a flexible attachment that permits a given, limited change in the angle between the mantle (6) and the furnace body (2). This angle may change as a result of movements of the furnace body (2) caused by thermal expansion. As a result of the inventive design of these attachments. these movements are eliminated, in the absence of any significant curvature or other deformation of the actual mantle (6).

13 Claims, 4 Drawing Sheets

METALLURGICAL FURNACE UNIT

BACKGROUND OF THE INVENTION

1. Field of the Invention

The present invention relates to a metallurgical furnace unit but includes a cylindrical furnace body which is adapted for rotational and/or pivotal or similar movements, these movements being made possible by means of at least one ring mounted outside the furnace body. The invention relates more specifically to a top-blown rotary converter.

2. Description of the Related Art

By "metallurgical furnace unit" is generally meant process apparatus with which pyrometallurgical unit processes are carried out at the highest temperatures required for the unit process concerned. The term "metallurgical furnace unit" as used in this document also includes furnace units in which metallurgical processes other than strictly pyrometallurgical processes are carried out, for instance inorganic high temperature processes. The furnace units may be smelting furnaces, kilns, or heat-treatment furnaces of different kinds, both for batch-wise processes and continuous processes. Such furnace units may be provided with one or more rings around the furnace body, these rings being generally known as mounting rings which can have the function of slide rings, tilt rings or support rings. A common feature of these rings is that they are seated outside the actual furnace body, i.e. outside the circular outer casing wall of the unit.

Many different types of metallurgical furnace units are available, each being designed for the specific movements to be carried out by said units. For instance, there are known to the art various kinds of continuously operating rotary furnaces which include several rings that rest on rollers, which may be drive rollers or solely support rollers, with the furnace slightly inclined. It is also necessary to design horizontally operating converters for different types of movement, e.g. a tilting movement or rotational movement about their respective long axes. Such converters also rest on rollers, either freely rotating or driven rollers, and can be tilted or rotated with the aid of said rollers. Also known in this art is a group of furnace units that can be commonly designated non-horizontal converters. A common feature of such converters is that they can be tipped or rotated about an axis that extends transversely to their longitudinal axes, and that they have a bottom part and an upper part which includes an opening opposite said bottom part in the longitudinal direction of the converter. Such converters may be upright converters of the type known as LD, Thomas, OBM or BOLD converters, or inclined rotary converters, often called TBRC or Kaldo converters.

In addition to being able to tilt and/or twist, rotary converters shall also be capable of rotating about their longitudinal axes, often at a relatively high speed. The converters are rotated in conjunction with mixing operations and reaction processes for instance, and are swivelled in conjunction with charging, blowing, slag withdrawal, furnace tapping and furnace relining operations.

A common problem with all metallurgical furnace units of the aforedescribed kind is that of mounting the ring or rings around the furnace body without causing complications in use as a result of the large temperature variations that occur in the furnace unit and the furnace walls during operation. These temperature variations propagate in both the space dimension and the time dimension. Moreover, the heavy weight of such furnace units and their contents cause problems when the furnace units shall be manoeuvred, i.e. rotated and pivoted or swivelled during the metallurgical processes. As a result of these temperature variations, the furnace unit will expand and contract alternately, both radially and longitudinally. Moreover, expansion of the furnace unit is not uniform over the whole of furnace body. Consequently, problems occur when the rings are mounted directly on the outer furnace wall, since the rings do not follow the movements of the furnace wall caused by thermal expansion. Consequently, the rings are either mounted with a predetermined amount of play or clearance or so that the rings are able to slide around the furnace body. However, this, in turn, results in undesirable gaps between rings and furnace body, which results in heavy wear on both rings and furnace walls, particularly because of the heavy loads that must be brought into motion when using the furnace.

Various constructive solutions to these problems have been proposed in recent years, such as the securement of rings and furnace body with various types of movable bolt connections, for instance. One such construction is described in GB-A 1218441, according to which a mounting ring is fastened to the furnace wall of, e.g., a Kaldo converter with the aid of supports and "resiliently" extensible bolts disposed in apertures of elongated cross-section which extend through the ring and the support parallel with the longitudinal axis of the furnace, such that the longitudinal axis of each opening that extends radially of the furnace at opposite ends of the bolts are respectively supported by bearing surfaces provided on the ring and support. This enables each bolt to pivot in the radial plane. The bolts thus actually function as some kind of obliquely outwardly acting link.

A common drawback with all known and tested constructions in which the rings are mounted on the furnace body is found in the enormous amount of wear on the furnace bodies, which demands frequent and regular maintenance work and therewith heavy maintenance costs are of cause entailed. It is for this reason that these known and tested constructions have not met with any real success. Naturally, the larger the furnace unit constructed, the greater the problems caused, since wear on the furnace bodies increases at higher loads. In view of the fact that charge weights often reach 100 tonnes, the aforesaid problems are highly significant. Any undesirable play in the furnace construction can become highly troublesome and result in prohibitive wear problems and, at high rotational speeds, also in a rotational imbalance which further worsens the wear problems.

DK-A 68786 proposes a solution in which support rings are connected to the outer surface of the furnace by means of so-called elastic supporting elements. These supporting elements are rigidly fastened in both the outer cylindrical surface of the furnace and the support rings, for instance with the aid of several rows of bolts. Each supporting element is forced to bend in order to take up furnace-body movements caused by thermal expansion. Because the intrinsic elasticity of the material is utilized in this respect, the solution can be effected technically and is also apparently a neat solution in the present context. To facilitate utilization of the elastic properties of such supporting elements, it is suggested that said elements are given the form of plates, iron shapes or profiles, or like elements, and that they are also connectable to a short cylindrical member at the end where said supporting members are joined to the furnace casing. When the furnace unit includes a casing, the casing will preferably include axial slots that facilitate bending of the elastic supporting members. In connection with the advent of the present invention, calculations were made on the earlier proposed, but never tested (as far as we are aware) attempts to solve the aforesaid problems associated with the thermal expansion of furnace bodies that include supporting rings. However, mechanical strength calculations made with modern computerised FEM analysis showed that the fatigue stresses occurring with heavy loads and a large number of load alternations (furnace rotations) in such a construction were so high as to subject the furnace body to the danger of fatigue fracture at several locations. This was particularly due to stress concentrations in the slot radii and attachment holes, which greatly reduced the useful life span of the construction. One reason why the apparently defective known construction has not been put to general use is perhaps because of negative experiences obtained in any test runs carried out. If so, it is today possible to explain such negative experiences with the aid of modern computerised strength calculations.

Although the invention is not restricted to rotary converters, as mentioned in the introduction, it is particularly with such furnace units that the problems relating to the securement of mounting rings is greatest, partly because of the special operating conditions prevailing with such converters, where it is necessary to both rotate and tilt, or pivot, the converter. These problems are well known to all metallurgists who have experience with rotary converters.

BRIEF SUMMARY OF THE INVENTION

An object of the present invention is to provide a metallurgical furnace unit whose design substantially eliminates the earlier problems relating to the attachment of mounting rings for use in rotating, tilting and/or pivoting the furnace unit. Another object of the invention is to provide a metallurgical furnace unit that is reliable in operation and that incurs lower maintenance costs than earlier known furnace units.

These objects are achieved with an inventive metallurgical furnace unit having the characteristic features set forth in the following claims.

The inventive furnace unit thus includes rings, i.e. mounting rings such as supporting rings, tilt rings and the like, which are fitted around the furnace body in spaced relationship therewith and each of which is connected to the furnace body by a force-transferring supporting member that extends in the longitudinal direction of the furnace unit and functions to prevent furnace body movements caused by thermal expansion to be transmitted to the ring while, at the same time, transferring the load from the furnace unit and its possible contents to the ring. According to the present invention, the supporting member is comprised of a closed casing, in the following called mantle, which surrounds the furnace body and which is connected to said body and to the ring respectively by a connection being flexible so as to permit a limited change in the angle between the mantle and the furnace body and ring respectively in response to said thermal-expansion movement in the furnace body. This solution eliminates the problems associated with such movement, without requiring the supporting member to bend or the actual mantle to be deformed in any way. Thermal expansion can thus be taken-up essentially with no deformation of the mantle. This can be expressed by saying that the mantle is "expansion absorbing".

Thus, by an "expansion absorbing mantle" is meant a mantle that is constructed and adapted to utilize the natural and specific properties of the construction material (normally steel), by virtue of the mantle following the thermal-expansion movements of the actual furnace body solely at its attachment to the furnace wall, by temperature adaptation, while the mantle retains at its other end a relatively constant diameter which is adapted to the mounting ring and its slight expansion in the present context, said other end being heated to lower temperatures and subjected to comparatively small variations in temperature.

The mantle may have a cylindrical shape and is then connected at one end, or in the proximity of said end, to a flange or the like which is attached to the furnace body and projects outwardly therefrom and whose radial extension shall correspond to the difference in diameter between the furnace body and the mounting ring when the furnace body is cold, i.e. when not thermally expanded. Alternatively, the mantle may have a conical shape and be connected to the furnace body at the end that has the smallest cross-sectional area.

Ideally, a heat-insulating shield can be provided between the mantle, or that part of the mantle that supports a mounting ring, and the actual furnace body, so as to maintain the temperature and the temperature variations of the ring and the support ring and associated bearings at the lowest possible level. The mantle and/or the flange projecting out from the furnace body may also be provided with air-throughflow holes. This facilitates the circulation of air between the furnace body and the mantle, so as to enable the surface temperature of the furnace body to be kept at an acceptably low level.

BRIEF DESCRIPTION OF THE DRAWINGS

The invention will now be described in more detail with reference to a preferred embodiment of a Kaldo converter and with reference to the accompanying drawings, in which.

DETAILED DESCRIPTION OF THE INVENTION

Figure 1:
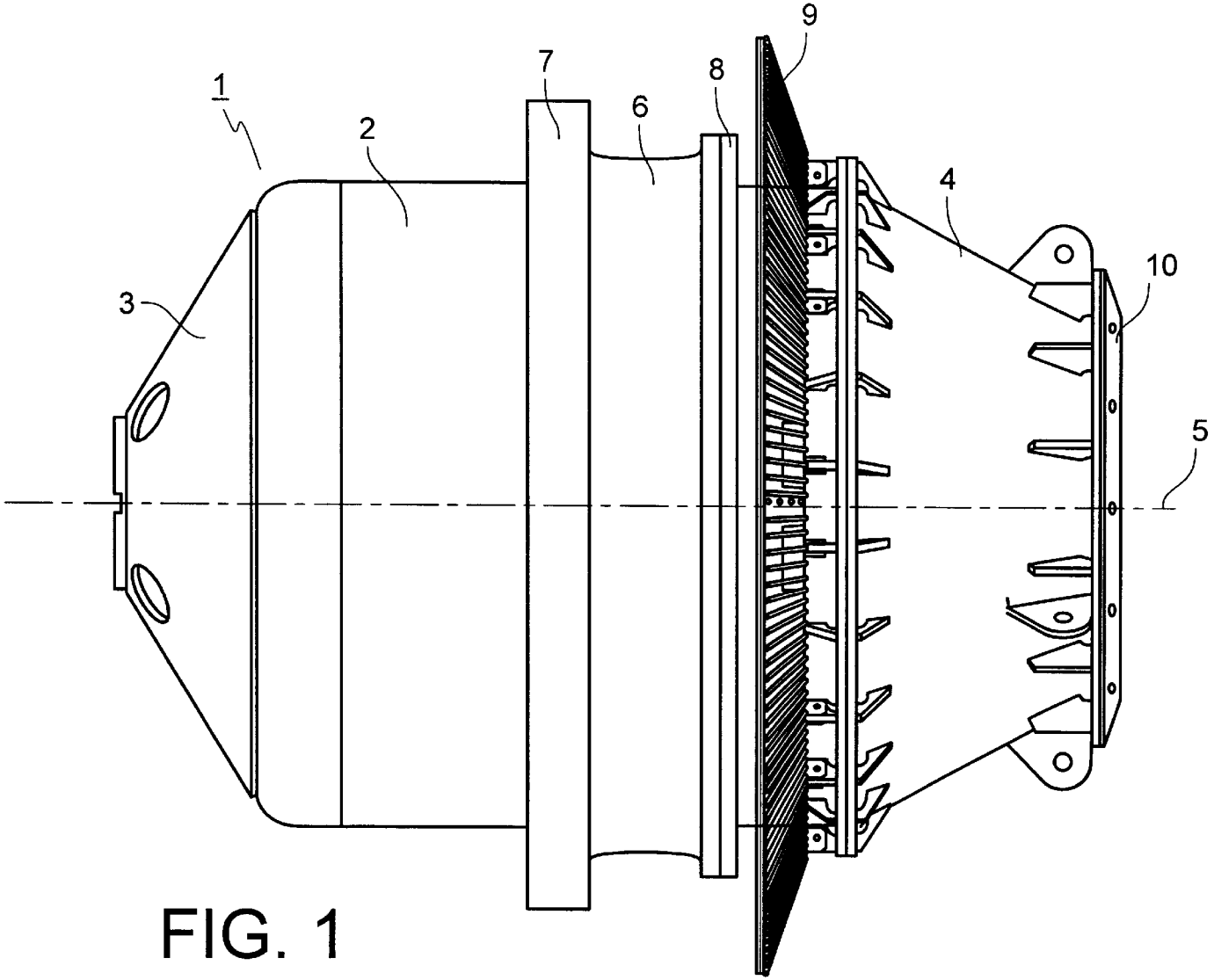
FIG. 1 is a side view of a furnace vessel for a Kaldo converter.
Figure 2:
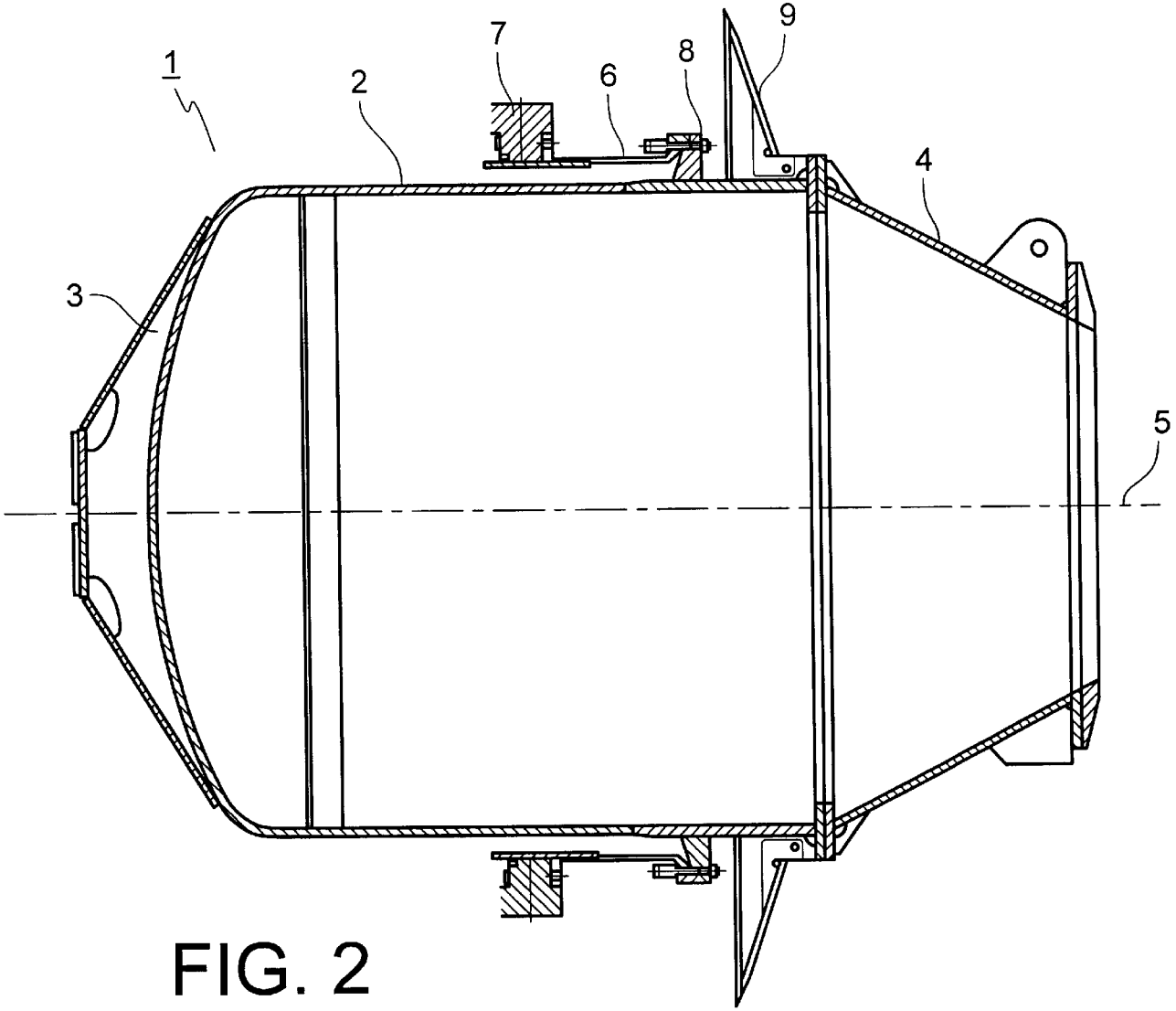
FIG. 2 illustrates the same furnace vessel in side view and in section.

Shown in FIGS. 1 and 2 is a Kaldo-type furnace unit 1 that includes a cylindrical furnace body 2 and a conical bottom part 3 and a conical upper part 4. The furnace unit 1 is rotatable about its geometric long axis 5. Provided outside a part of the cylindrical furnace body 2 is an expansion-absorbing mantle 6 which carries a support ring 7 at one end. The mantle 6 is connected to the furnace body through the medium of a circular flange 8 that projects out from the cylindrical furnace body around the whole of its circumference and is connected thereto. The manner in which the mantle 6 is mounted will best be seen from FIG. 2. Also mounted on the furnace body 2 is a protective ring 9 that prevents slag and other coarse pieces of material from entering between the support ring 7 and support wheels 13. Alternatively, the mantle 6 can be attached directly to the furnace body 2. In this latter case, the mantle 6 will have a conical shape. The attachment of the mantle 6 to the furnace body 2 or to the furnace-body flange 8 and the support ring 7 respectively has the form of a flexible connection. This flexible connection may be achieved in different ways. For instance, attachments that have the common ability of permitting limited angular changes to take place in the connection can be obtained by specially designed welding with clamping connections or a specially designed flange connection. The attachment at both ends of the mantle 6 is thus designed so as to obtain a suitably adapted transmission of heat and therewith also equalization of temperature at the attachment points. The mantle 6 may be made of any structural steel quality considered suitable for the particular application in each individual case.

Figure 3:
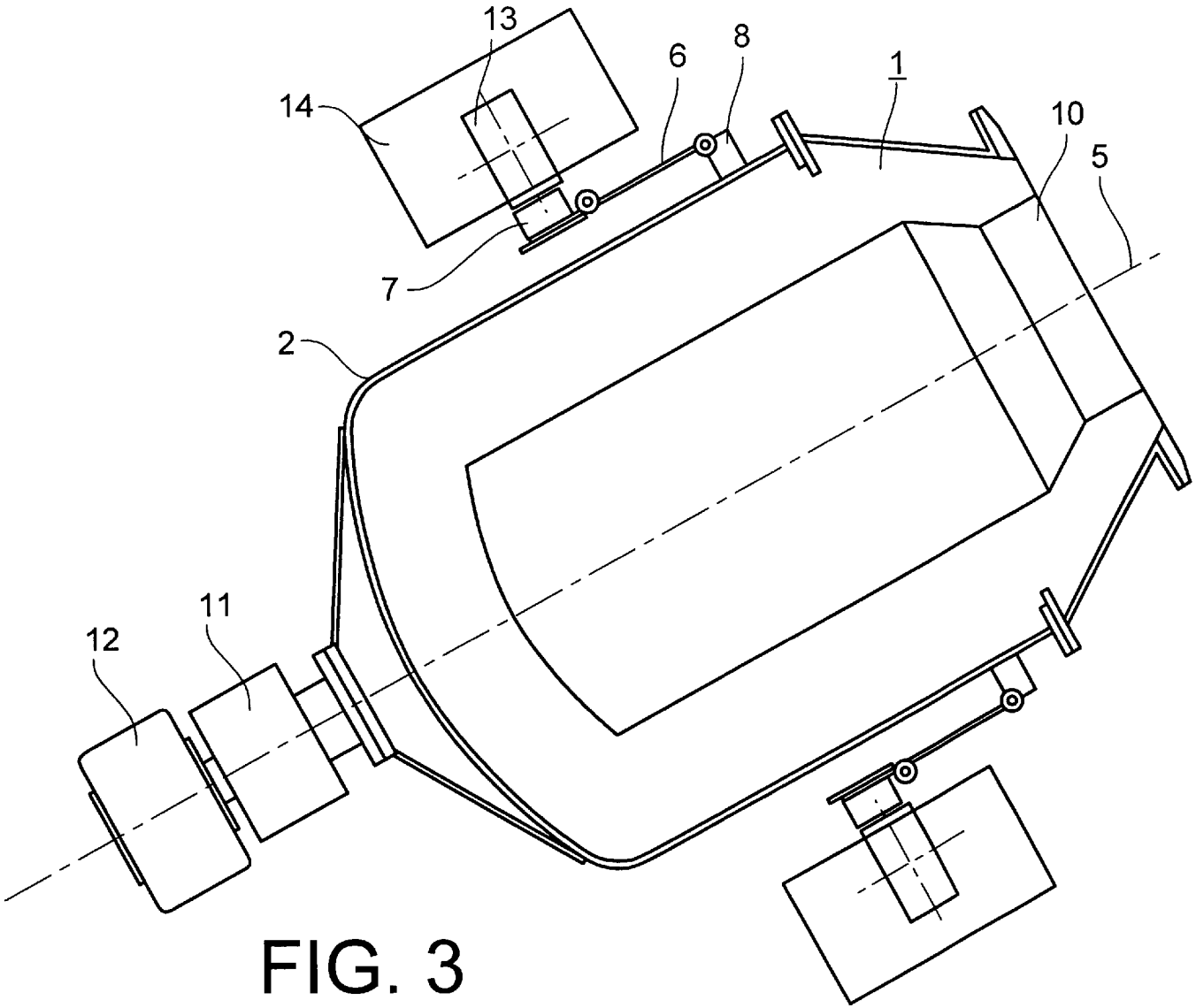
FIG. 3 illustrates the principle of a Kaldo plant.

FIG. 3 shows a Kaldo plant with the furnace unit in its use position. The furnace unit 1 is inclined in its longitudinal direction and rests on a support bearing 11 and is rotated about its longitudinal axis 5 by means of a drive motor 12, which may be an hydraulic motor or an electric motor that includes a gearbox. The furnace unit 1 rotates while resting on support wheels 13 disposed along the lower part of the furnace unit 1. The wheels 13 rest in bearings in a supporting construction 14. The furnace unit 1 is provided with a support ring 7 which is mounted on one end of an expansion-absorbing mantle 6, which, in turn, is attached to a flange 8 welded to the cylindrical furnace body 2 or anchored thereto in some other appropriate manner.

Figure 4:
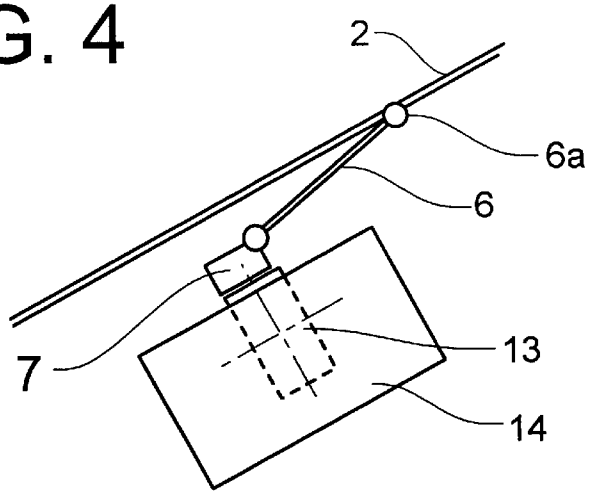
FIG. 4 the principle of the flexible attachment of the mantle to the furnace and FIG. 5 illustrates a preferred practical embodiment of the attachment of the mantle according to the invention.

FIG. 4 illustrates the attachment of a conical expansion-absorbing mantle 6, wherein the mantle-end of smallest cross-section is flexibly anchored directly to the furnace body 2, said attachment point 6*a* being illustrated symbolically by a solid circle, as are also the other non-rigid or flexible attachment points. The conical mantle 6 has the same function as the cylindrical mantle 6 shown in FIG. 3.

Figure 5:
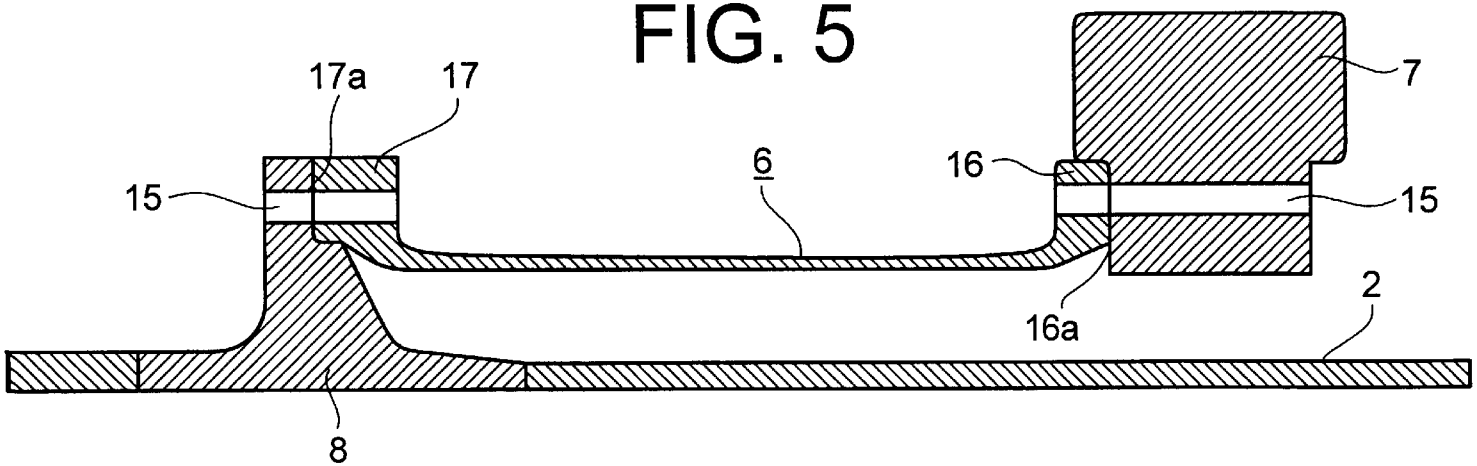

FIG. 5 shows a preferred embodiment of the attachment of a mantle of the expansion-absorbing type. The furnace body 2 has a flange 8, which in a recess 17*a* accomodates a mantle flange 17 constituting as shown at the figure the left part of the mantle 6. The right part of the mantle 6 is also formed as a flange, designated 16, which is accommodated in a correspondingly formed recess 16*a* of the support ring 7. Through furnace body flange 8 and left mantle flange 17 as well as through support ring 7 and right mantle flange 16 are provided openings 15 for bolt connections (not shown). The mantle flanges 16,17 have a compact form and are optimized by computerised calculations of the so called FEM type and they have both only a small contact surface against the support ring 7 and the furnace body flange 8. Thus, a change in the angle between flange 16,17 and the support ring 7 and furnace body flange 8, respectively, can be carried without the arising of inadmissible stress or tensions either of the bolts or the flanges 16,17. It is also of importance to select the fit between support ring 7 and the mantle flange 16 so as to prevent any radial play between these parts. In this way the mantle 6 is attached so flexible to both the support ring 7 and the furnace body flange 8 so as to permit the same to accompany the radial movement of the flange 8 to a new position provided by the radially movement of the furnace body 2 when expanding by means of the heat inside the furnace. However, because the support ring 7 is not heated but is kept as cool as possible irrespective of the changes in temperature of the furnace unit 1 and its furnace body 2 the position of the support ring 7 will remain unchanged and the mantle 6 will take an essentially conical shape.

Movement of the furnace body 2 and the furnace body flange 8 as a result of thermal expansion is thus essentially taken-up by the mantle 6 and its connections. No significant amount of heat is transferred from the furnace body to the support ring 7 through the mantle 6. The dominant potential heat source for heating the support ring 6 is the radiation from the furnace body 2. The support ring 7 can be shielded against this heat radiation, by providing insulating material (not shown) between the support ring 7 and the furnace body 2.

EXAMPLE

There are recently erected two Kaldo furnaces using the invention system for the fastening and connection of the support rings to the furnace unit. One unit is in a copper plant in Kazakhstan and the other at the Rönnskär smelter in Sweden owned by Boliden A B. Both of the units are of equal size and have the following main technical specifications:

| | |
|---|---|
| Total weight (without bricks and smelt) | 21300 kg |
| Smelt weight (in operation) | 6000 kg |
| Brick weight | 18500 kg |
| Maximum tilting speed | 0.6 rpm |
| Maximum rotation speed | 20 rpm |

Both furnaces have been in operation for about 8 months without any problems caused by the support ring connection.

At a recently made inspection of the unit at Rönnskär with special care of the tightening moments of the bolt connections and of any wear or other damages of the support ring it could not been observed any changes of the equipment from its supply state. Thus, hitherto the furnace unit has highly proved to fulfil all the aims regarding obtaining an essentially maintenance-free support ring connection.

We claim:

1. A metallurgical furnace unit having a cylindrical furnace body adapted for rotation and/or tilting movement and provided with at least one ring which is arranged outside the furnace body and functions to enable said movement to take place, wherein each ring is disposed at a distance from the furnace body and connected thereto by a force-transferring supporting member which extends in a longitudinal direction of the furnace unit and which is adapted to prevent the transfer to thermal-expansion movement of the furnace body to the ring and to take-up external loads from the intrinsic weight of the furnace body and the weight of the furnace charge, wherein the supporting member comprises a closed mantle which surrounds the furnace body and which is connected to the furnace body and to the ring respectively by an attachment being so flexible as to permit a limited change in the angle between the mantle and the furnace body that can occur as a result of movements of the furnace body caused by thermal expansion, therewith eliminating said movements in the absence of any significant curvature or other deformation of the mantle.

2. The metallurgical furnace unit according to claim 1, wherein the mantle is cylindrical and is connected at one end or at a location in the proximity of said one end to a flange fastened to the furnace body and projecting outwardly therefrom.

3. The metallurgical furnace unit according to claim 1, wherein the mantle is conical and attached to the furnace body at its end of smallest cross-section.

4. The metallurgical furnace unit according to claim 3, wherein a heat insulating shield is disposed between the ring and the furnace body.

5. The metallurgical furnace unit according to claim 4, wherein the mantle and/or flange on the furnace body includes through-penetrating, air-cooling holes.

6. A top-blown rotary converter having a cylindrical furnace body, a conical bottom part and an upper part and having a support ring disposed outside the cylindrical furnace body, said support ring being spaced from the furnace body and connected thereto through the medium of a cylindrical or conical supporting member which extends in the longitudinal direction of te converter and functions to take-up movements caused by thermal expansion of said furnace body, wherein the supporting member is comprised of a closed mantle which surrounds the furnace body and which is connected to the furnace body and to the ring respectively with a flexible attachment that will permit given, limited angle-changes between the mantle and the furnace body, said angle changes being liable to occur as a result of movements of the furnace body caused by thermal expansion, wherewith said movements are eliminated in the absence of significant curvature or other deformation of the actual mantle.

7. A metallurgical furnace unit according to claim 2, wherein a heat insulating shield is disposed between the ring and the furnace body.

8. A metallurgical furnace unit according to claim 1, wherein a heat insulating shield is disposed between the ring and the furnace body.

9. A metallurgical furnace unit according to claim 3, wherein the mantle and/or the flange on the furnace body includes through-penetrating, air-cooling holes.

10. A metallurgical furnace unit according to claim 2, wherein the mantle and/or the flange on the furnace body includes through-penetrating, air-cooling holes.

11. A metallurgical furnace unit according to claim 1, wherein the mantle and/or the flange on the furnace body includes through-penetrating, air-cooling holes.

12. A metallurgical furnace unit according to claim 8, wherein the mantle and/or the flange on the furnace body includes through-penetrating, air-cooling holes.

13. A metallurgical furnace unit according to claim 7, wherein the mantle and/or the flange on the furnace body includes through-penetrating, air-cooling holes.

* * * * *